United States Patent [19]

Ruff

[11] 4,216,095

[45] Aug. 5, 1980

[54] DYNAMIC DENSE MEDIA SEPARATOR

[75] Inventor: Henry J. Ruff, Southampton, United Kingdom

[73] Assignee: Sala International AB, Sala, Sweden

[21] Appl. No.: 19,583

[22] Filed: Mar. 12, 1979

Related U.S. Application Data

[63] Continuation of Ser. No. 843,207, Oct. 18, 1977, abandoned.

[30] Foreign Application Priority Data

Oct. 20, 1976 [SE] Sweden ..... 7611644

[51] Int. Cl.[2] ..... B04C 3/06

[52] U.S. Cl. ..... 210/512 R; 209/211

[58] Field of Search ..... 210/512 M, 512 R, 84; 209/168, 172.5, 211, 144

[56] References Cited

U.S. PATENT DOCUMENTS

| | | | |
|---|---|---|---|
| 2,698,672 | 1/1955 | Burnside et al. | 209/211 |
| 2,719,631 | 10/1955 | Vicard | 209/211 |
| 2,725,983 | 12/1955 | Rakowsky | 209/211 |
| 2,726,768 | 12/1955 | Rakowsky | 209/211 |
| 2,799,208 | 7/1957 | Scott | 209/211 |
| 2,806,599 | 9/1957 | Patrick | 209/211 |
| 2,822,157 | 2/1958 | Porter | 210/512 R |
| 2,917,173 | 12/1959 | Rakowsky | 209/172.5 |
| 3,219,186 | 11/1965 | Polhemus | 209/211 |
| 3,440,806 | 4/1969 | Damratowski | 209/211 |
| 3,504,804 | 4/1970 | Newman et al. | 209/211 |

FOREIGN PATENT DOCUMENTS

| | | | |
|---|---|---|---|
| 1350838 | 12/1964 | France | 209/172.5 |
| 155218 | 7/1956 | Sweden | 209/172.5 |
| 181522 | 8/1957 | Sweden | 209/172.5 |
| 1100343 | 1/1968 | United Kingdom | 209/172.5 |
| 1113601 | 5/1968 | United Kingdom | 209/172.5 |

*Primary Examiner*—William A. Cuchlinski, Jr.
*Attorney, Agent, or Firm*—Young & Thompson

[57] ABSTRACT

A dynamic dense media separator, comprising a cylindrical separation vessel with an axial outlet—float outlet—for separated material fractions of a lower density together with dense media, an outlet on the cylindrical surface of the separation vessel—a sink outlet—for separated material fractions of a higher density together with dense media, and either an inlet on the cylindrical surface of the separation vessel for dense media as well as material to be separated, or such an inlet only for dense media, and an axial inlet for material to be separated together with a minor portion of the dense media. Of the two outlets and inlets situated on the cylindrical surface of the separation vessel, at least the outlet has the shape of an involute connection piece which at least partially surrounds the separation vessel and is bent essentially in the direction of the circumference of the vessel.

4 Claims, 1 Drawing Figure

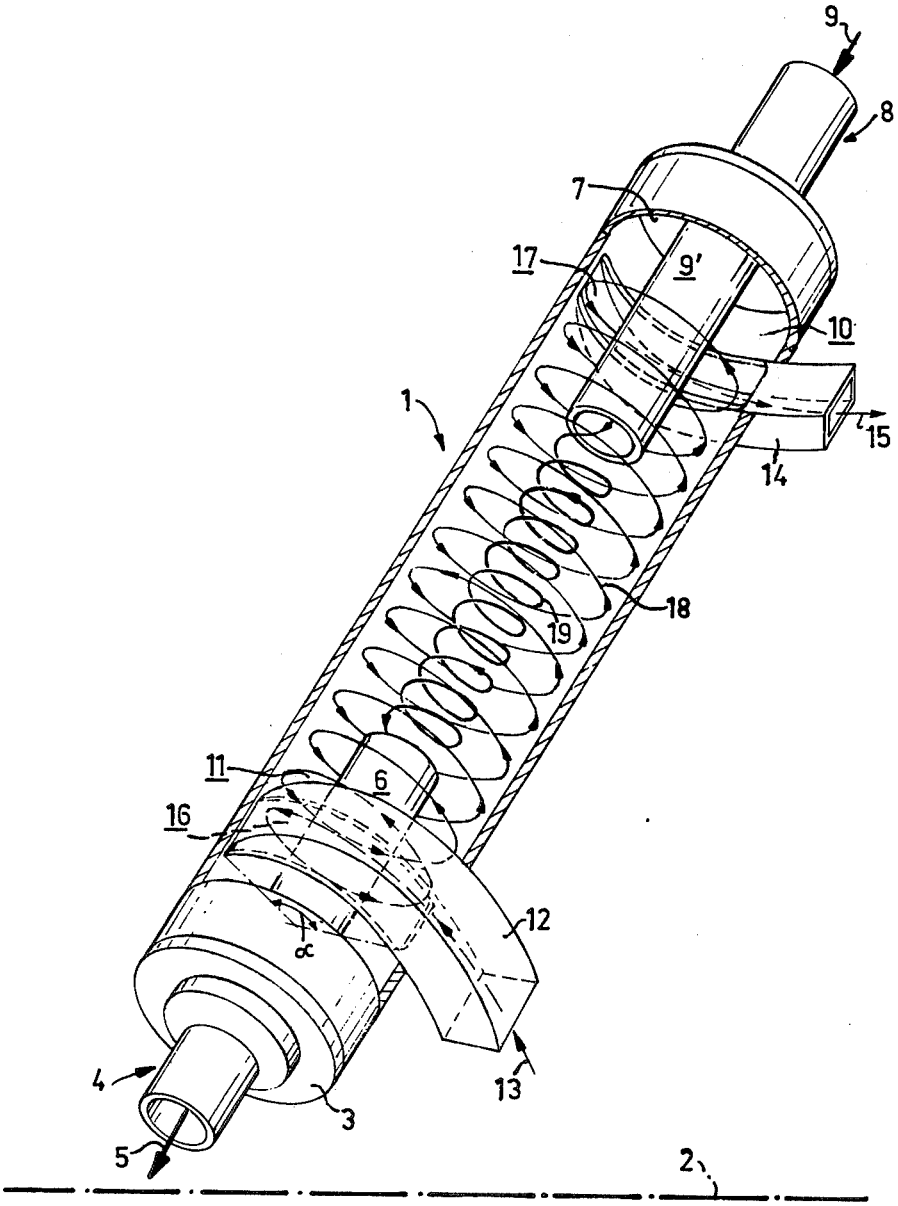
9
8
7
17
9'
10
1
15
14
18
19
11
6
16
12
α
4
13
3
5
2

DYNAMIC DENSE MEDIA SEPARATOR

This is a continuation of application Ser. No. 843,207, filed Oct. 18, 1977, now abandoned.

This invention relates to a dynamic dense media separator, comprising a cylindrical separation vessel with an axial outlet (float outlet) for separated material fractions of a lower density together with dense media, an outlet on the casing surface of the separation vessel (sink outlet) for separated material fractions of a higher density together with dense media, and either an inlet on the casing surface of the separation vessel for dense medium as well as material to be separated, or such an inlet for dense medium only as well as an axial inlet for material to be separated together with a minor portion of the dense media.

In a known device of this type the separation of the material fractions after their various densities is accomplished by a swirling dense media comprising a liquid suspension of fine particles with high density. This dense medium is introduced tangentially at the lower end of an inclined, cylindrical separation vessel and forms a rising whirlpool. At the higher end of the separation vessel a part of the dense media is discharged from the vessel through the tangential sink outlet, while the rest of the dense media is diverted to the lower end of the vessel, where it moves in the shape of a central whirlpool, which rotates in the same direction as the rising whirlpool and is co-axial with and circumferenced by the same. At the lower end of the vessel the dense media is discharged through the axial float outlet, comprising a tubular part protruding into the vessel, which extends past the inlet for dense medium situated on the casing surface of the separation vessel. At the extension of the sink outlet there is a hose which deposits the concentrated material at a suitable place, while the float outlet has an open discharge.

Under the influence of the centrifugal force in the whirlpools, there is a segregation of the fine particles of the dense media, so that the media density is increased in the direction leading from the centre of the vessel to its periphery and from its bottom end to its top end. The axial inlet for the material (which is intended) to be separated is arranged in this end. This inlet comprises a tubular part protruding into the vessel, which extends past the sinks outlet situated on the casing surface of the vessel.

The material to be separated, which may be classified and if necessary deslimed, is introduced together with a minor portion of the dense medium through the axial inlet, and is thereby brought in contact with the swirling dense medium in the separation vessel, and initially with the inner descending whirlpool. Under the influence of a centrifugal force the material penetrates the dense medium whirlpools until it reaches the level where the material has the same density as the dense media. The lighter material fractions remain in the inner descending whirlpool and accompany the same and are discharged together with a portion of the dense medium through the float outlet, while the denser material fractions penetrate out to the rising outer whirlpool and accompany the same to the sink outlet for discharge from the separation vessel together with the remaining portion of the dense media.

Those fractions of the material which have a density close to the separation density, only slowly penetrate through the inner whirlpool out towards the outer whirlpool and reach the latter in viscinity of the float outlet. The parts of those fractions, which have a greater density than the separation density, will under ideal conditions penetrate into the outer whirlpool and be carried away by this to the sink outlet. However, during practical operation many material particles with a density close to the separation density will arrive at the wrong outlet. This means that valuable material is lost in the waste at the same time as the valuable material is diluted with waste material. These two disadvantages will, however, be of minor importance, and the loss of valuable material be small compared to the theoretical maximum yield if only material particles with density very close to the separation density arrive at the wrong fraction. However, if the separation is less sharp and also material particles with a greater difference in density arrive at the wrong fraction, this means a considerable loss in yield as well as a reduction of the concentrate grade, both of these circumstances of course reducing the economic yield of using the prior art apparatus. This is especially obvious if a great part of the material to be separated comprises particles with a density close to the separation density.

At the prior art apparatus the dense media is pumped into the separation vessel under pressure, and in order to reach optimum separation conditions a counter pressure is required in the sink outlet. This is attained by a constriction bush mounted in this outlet or also by lifting the end of the sink discharge hose to such a level that a hydrostatic counter pressure occur. Furthermore, it is necessary that the flow conditions in the separation vessel are as smooth and uniform as possible. However, these preconditions are not met with in the prior art apparatus, which instead shows an irregular flow pattern, because there is strong turbulence and unstable flow conditions in the vicinity of the float outlet in the separation vessel. Furthermore, the inner descending whirlpool is not concentric with the (geometrical) axis of the cylindrical separating vessel but is instead displaced somewhat in relation to this. Because of this, it is eccentric to the float outlet, whereby the separation density inevitably will be different on the opposite side of the whirlpool which, together with the strong turbulence mentioned above will to a high degree contribute to the fact that the prior art apparatus shows a less satisfactory sharpness of separation.

However, irregularities in the flow do not only occur in the vicinity of the float outlet in the prior art apparatus. Such irregularities also occur in the vicinity of the sink outlet because, under practical working conditions, there will be cloggings in this area which obstruct the discharge of the separated material fraction with high density and reduce the sink capacity of the prior art apparatus.

Another prior art apparatus of the kind mentioned in the introduction comprises a vertical cylindrical separation vessel which has a tangential inlet for a mixture of dense media and the material to be separated at the top end of the cylindrical surface of the separating vessel. The upper and larger part of this vessel forms a high main separation chamber, while the lower and smaller part of the vessel forms a low sinks material discharge chamber which is cylindrical and has the same diameter as the main separation chamber. The bottom provided with an adjustable central opening separates the main separation chamber from the sink discharge chamber underneath. The opening, which is adjustable in size, is the sink discharge opening for the main separating chamber, from which the separated high density product (sinks) is diverted to the sinks discharge chamber. The separation vessel has a tangential sinks outlet on the casing surface which circumferences the sink discharge chamber, through which the sinks product together with dense medium is finally diverted from the separation vessel to an adjacent second cylindrical sink discharge chamber. The latter is vertical, has low height compared to the separation vessel and has a tangential inlet and a central axial bottom outlet adjustable in size for the sink product, which together with dense media leaves the apparatus through this outlet. Through the central opening in the main separation chamber flow which constitutes the sink outlet from this chamber, an axial tube protrudes into the main separation chamber to such level within it that the upper end of the tube will be in the upper part of the main separation chamber but below the common inlet for the mixture of dense medium and material to be separated in the apparatus which is situated on cylindrical surface of the separating vessel. This tube constitutes a float outlet for the main separation chamber and the apparatus as a whole, through which low density product which is separated in this chamber leaves the apparatus together with dense medium.

In analogy with the principal action of the first described prior art apparatus, the dense media and the material to be separated during the treatment in the second prior art apparatus moves towards the sink outlet in an outer whirl and towards the float outlet in an inner whirl surrounded by the outer whirl, while the density of the dense media increases in a direction from the inside of the main separation chamber towards its cylindrical wall as well as in a direction from the inlet to the main separation chamber to its sink outlet. Material particles belonging to the low density fractions situated close to the wall of the separation vessel float up from these positions to a level in the separation chamber, where the prevailing dense media density corresponds to the density of the particles and then follows the dense media towards the outlet to which it is moving. Particles belonging to the high density fractions on the other hand are thrown out towards the cylindrical wall of the main separation chamber and follow this in a spiral path towards the bottom of the chamber along which they will then travel towards the opening. Particles near the separation boundary will move only slowly towards the boundary for the fractions which lead to the floats and the sink discharge opening respectively, and thereby they of course are more likely to arrive at the wrong fraction.

The second sink discharge chamber mentioned above acts as a brake for the sink material flow and causes a counter pressure in the separation vessel. The size of the outlet from this chamber is made to suit the amount of feed material for the sink product. The size of the outlet will also have an influence on the amount of dense media which is discharged through the sink outlet. Together with the feed density of the dense media and the inlet pressure, these are the most important factors for control of the separation density, i.e. the density where the separation of the material particles takes place.

As is the case with the first-mentioned prior art apparatus, it is important even for the second prior art apparatus that the flow conditions are as stable as possible in order to achieve optimum result, and that the inner whirlpool is smooth and co-axial both with the separation vessel and with the float outlet, i.e. the tube which is protruding into the main separation chamber. However, in the other of the two part apparati, it has been found that, during practical operating conditions, the inner whirlpool is displaced and it is positioned excentrically to the float outlet, which, of course, entails that the separation density limit will be different on the opposite sides of the whirl. Furthermore, it has been found that the regularity of the whirlpool is disturbed in the vicinity of the inlet to the apparatus, which, of course, will also deteriorate the separation conditions at the float outlet.

Furthermore, similar to the case of the first mentioned prior art apparatus, the second prior art apparatus also seems to be suffering from clogging at the sink outlet which, of course, will cause increased wear on the apparatus and an irregular product flow. Due to the clogging at the sink outlet, the irregularities of the product flow will furthermore cause irregular conditions in the main separation chamber, which affects both the sharpness of separation as well as the separation density.

Another dynamic heavy media separator which has a very wide use is the HMS-cyclone. This comprises a cylindrical separation chamber which downwardly converts changes into an inverted cone having an outlet for sink material particles in the apex of the cone. The other end of the cylindrical separation chamber is covered with a top plate which has a central overflow pipe which protrudes into the separation chamber. A mixture of dense media and particles to be separated is introduced under pressure through a tangential opening in the cylindrical part of the separation chamber and is there provided with a whirling movement under development of an airfilled central vortex. Just like the prior art apparati mentioned above, there is a segregation of the media particles so that the density increases from the central vortex to the wall of the separating chamber and from the inlet to the sink outlet in the apex of the cone. The particles to be separated will find their way to a level where their density coincides with the density of the media and will then follow the movement of the media at this level. Particles having a higher density will move along the wall of the separating chamber until they are discharged through the apex of the cone. In doing this, there will be considerable wear on the wall of the separation chamber and on the sink material particles so that fine sink material particles will be formed. The HMS-cyclone has a large density gradient between the medium which goes to the overflow and the underflow, and the separation takes place at a higher density than the density of the incoming media. Only a minor part of the medium will leave through the sink outlet and the sink material particles will occupy a considerable part by volume of the total underflow. Because of this, the HMS-cyclone is sensitive to fluctuations in the amount of material to be separated or the size of the sink fraction in this material because a pronounced change in the amount of sink material will cause a change in the separation density.

The purpose of this invention is an improved dynamic dense media separator as described in the introduction, where the disadvantages of the prior art apparatus are remedied.

Such a separator according to the invention which has shown during trial test work that it in all essential details will fulfil this aim, is primarily characterized in that, of the two outlets and inlet (14,12) situated on the casing surface of the separation vessel, at least the outlet has the shape of an involute connection piece with a shape which is known as sucn, which at least partially surrounds the separation vessel and is bent essentially in the direction of the circumference of the vessel.

Owing to the fact that at least the outlet of the two outlets and inlets on the casing of the separation vessel body to a separator according to the invention has the shape of an involute piece which at least partially surrounds the separation vessel and is bent essentially in the direction of the circumference of the vessel, the removal of the denser material fractions from the vessel is facilitated so that no clogging will occur in this outlet and the flow pattern will be smooth and undisturbed in that part of the separation vessel which is closest to the sink outlet. If the outlet on the side of the cylindrical wall of the vessel exhibits a connection piece according to the invention, the flow entering the vessel will be provided with a whirling movement even before its entrance into the separation chamber proper, said whirling movement facilitating the generation of smooth and concentric whirls in that third of the separation vessel which is closest to the inlet in the axial direction. If both the outlet and the inlet comprise involute connection pieces according to the invention, we obtain all these advantages and we get a smooth and well-centered whirling movement over the full length of the separating chamber.

Looking lengthwise at a connection piece according to the invention, its curvature should increase slowly in the direction towards the casing wall of the separation vessel so that an inflow will be guided into, and an outflow guided out of the cylindrical shape of the wall of the separation vessel in as close a connection as possible.

An especially favourable embodiment of a dynamic dense media separator according to the invention comprises one or two involute connection pieces, where the openings in the wall of the vessel occupies at least 50° and preferably at least 70° of the circumference of the vessel wall. In this way a considerable portion of the vessel wall is circumferenced by the connection piece or connection pieces, which will contribute to make the flow through the separator more uniform. In an extreme case, an opening in the vessel will near the involute connection piece according to the invention may occupy nearly a full turn.

Further flow improvements may be achieved in particular if the involute connection piece according to the invention which constitutes the inlet opening extends in a helical path around the vessel instead of being in a plane which is perpendicular to the geometrical axies of the separation vessel. In this way the entering flow is given a helical movement which at least approximately coincides with the whirling movement which occurs in the vicinity of the cylindrical wall of the separation vessel. The connection piece opening can in this case even extend more than a full turn of the separating vessel circumference.

It is advisable to make connection pieces according to the invention in the same shape, irrespectively if it is to be used as an inlet or outlet. In this way, the two connection pieces will be interchangeable and the amount of spare parts will be reduced.

An involute connection piece according to the invention may have various shapes of the opening in the wall of the separation vessel. For instance, such a connection piece used as a dense media inlet is essentially rectangular. The corners of the opening are then preferably rounded. Another beneficial shape of the opening of the involute connection piece according to the invention is the elliptical shape, and the major axis of the ellipse should then be parallel to the longitudinal axis of the vessel. This type of opening is especially suitable as a sink outlet and as a common inlet for material and dense media, and it should have a minimum dimension which is three times the diameter of the largest particle passing through the opening.

From what is mentioned above, it is evident that the connection piece according to the invention should also be bent outside that part of itself which is connected to the separating vessel.

When using an involute connection piece according to the invention as a sink outlet, the wear of the separation vessel will also be less because the sink material can leave the separation vessel in a gentle way simultaneously as the separation conditions are improved because of the more uniform flow conditions.

Because no clogging will take place in the sinks outlet you also gain the advantage that there is less abrasion of the sink product. This means that there will be an increased yield of sink product in a coarse-particulate state, which is especially valuable when the sink product comprises a finished concentrate which does not require any further treatment, or a finished tailing product which you want to discard with the least possible handling. In the prior art apparati, it has also been shown that fine material worn off from the sink product contaminates the dense media and gives it a lower density and often a higher velocity, and this can influence the process in negative manner in the prior art apparati. Such inconveniences are reduced in a separator according to the invention.

Because a separator according to the invention is not prone to clog at the sink outlet, it will be possible to operate it with a considerably smaller ratio between dense medium and sink product in the sink product discharged through the same. Furthermore, this means that the capacity of the separator for a given medium flow will increase, resulting in a reduced power requirement per volume or weight unit of treated material.

A separator according to the invention can also maintain a stable flow with a straight and smooth inner vortex at an inlet pressure which is considerably lower than the corresponding pressure in the prior art apparati. This will mean a reduced power requirement.

In an apparatus according to the invention having an involute sink outlet, it has been shown that the pitch of the outer whirl was practically constant over the full length of the separating vessel while it was found in the prior art apparati that the pitch decreases continuously from the inlet to the sinks outlet.

Finally, tests with a separator according to the invention having an involute sink outlet have revealed that the importance of the counter pressure for obtaining good flow conditions and a straight inner vortex is not as apparent as in the corresponding prior art apparati. It was also found that it was possible to obtain good operating conditions with no counter pressure at all. This indicates that it is much easier to control the operation of a separator according to the invention than is the case in the prior art apparati. This is because of the fact that the counter pressure in the prior art apparati is one of the operation variables which is most difficult to control, and this is the reason that many prior art apparati operate far from optimum separation results.

By using an involute connection piece according to the invention you eliminate as already described above the creation of turbulence in the dense medium at the inlet in the separation vessel. This provides the desired smoother and more uniform separation conditions which secure a sharper separation of sink product and float product according to their density. Furthermore, there will be less wear on the separation vessel and less power requirement because the pressure drop which is caused by turbulence is eliminated. The inner one of the two whirlpools in the separation vessel will also be considerably better centered than is the case in the prior art apparati. Test has shown that the improved flow conditions in a separator according to the invention will extend to at least one third of the length of the separation vessel, at least for separation vessels of a type having an opening in the cylindrical wall of the vessel which is only intended for dense media.

Among the advantages of a separator according to the invention, the increased sharpness of separation between sinks product and floats product according to density is absolutely the most important advantage. At present, the first of the prior art apparati as described above are excluded from many applications because of its inferior separation ability.

The invention will be described below with reference to the enclosed drawing which schematically illustrates an embodiment of a dynamic dense media separator according to the present invention. In the drawing, said embodiment is shown in a partially axially cut side view.

The FIGURE shows a separator according to the invention comprising a cylindrical separation vessel 1. In this embodiment of the invention, this vessel is arranged at an inclination to the horizontal plane 2. It has a bottom 3, which has an axial float outlet 4 for material fractions of a lower density which are separated in the vessel and which are discharged from the vessel together with used dense media. This is indicated by the arrow 5.

The float outlet 4 comprises in principle a tubular connection piece protruding out of the vessel which is centrally located in the bottom of the vessel 3 and whose opposite free end 6 extends into the bottom part of the vessel.

At its upper end the vessel 1 has a top plate 7, which is furnished with an axial inlet 8 for the material to be separated in the vessel, which is introduced into the vessel together with dense media. This is indicated by the arrow 9.

The inlet 8 for material to be separated comprises as is the case with the float outlet 4, in principle one tubular connection piece protruding out of the vessel. This is centrally positioned in the top plate 7, and its opposite free end 9 extends into the top part of the vessel.

Between the free tube ends 6, 9 extending into the bottom and top end of a separation vessel 1 and the cylindrical wall of the vessel, two annular rooms are arranged in the vessel, an upper one 10, and a lower one 11.

In the area of the lower angular room 11 another inlet 12 is arranged on the cylindrical wall of the vessel, said inlet being solely for the introduction of dense media into the vessel. This is indicated by the arrow 13.

At the top end of the vessel 1 and within the upper angular room 10, there is another outlet 14 arranged on the cylindrical surface of the vessel. To this outlet, which comprises the sinks discharge outlet of the separator, the material fractions of higher density which are separated in the separation vessel are discharged together with dense media from the vessel. This is indicated by the arrow 15.

In the shown embodiment, both the dense media inlet 12 as well as the sink outlet 14 on the cylindrical surface of the vessel 1 have, the for the invention characteristic shape of involute connection pieces which at least partially surround the separation vessel and are bent essentially in the direction of the circumference of the vessel. Both of them exhibit openings 16, 17 in the wall of the vessel, which extend over at least 50° and preferably at least 70° of the circumference of the vessel and which have an essentially rectangular shape ($\alpha \geq 50°$). Both of the involute connection pieces are also bent outside of their parts which are connected to the vessel wall in order to make the inflow into and outflow out of the vessel 1 as free of turbulence as possible. Even if they are straight outside of their parts which are connected to the vessel, you will obtain considerably improved operating conditions compared to the prior art apparati.

When the shown separator is in operation, the dense medium is pumped through the inlet 12 into the vessel 1. This dense media will move as is shown by the arrow 18 in a whirlpool along the wall of the vessel up to and into the upper angular room 10, where a part of the dense media having a higher density is discharged through the sink outlet while the rest of the dense media having a lower density is guided into an inner central whirlpool or vortex as indicated by the arrows 19 and moves towards the float outlet 4,6. After passing through the tube end 9', the mixture of material to be separated and dense media which is coming in through the inlet 8 into the vessel reaches the central portion of the vessel 1 where it is caught by the central inner vortex and brought into a whirling motion. Thus, the central descending whirlpool will be surrounded by the whirlpool rising along the vessel wall and rotate in the same direction as said rising whirlpool. The separation of the material will take place in the known way described in connection with the prior art, whereupon the separated float product will leave the separation vessel 1 together with dense media through the floats outlet 4 while the separated sink product will leave the vessel through the sink outlet 14 together with dense medium of a higher density.

Although one embodiment has been described having a side inlet solely for dense medium, it is evident from the above that a separator according to the invention may also have a side inlet of a type which, alone, will introduce both the necessary dense media as well as the material to be separated into the separation vessel 1.

Furthermore, it is evident from what is mentioned above that the openings of the involute connection pieces 16, 17 in the cylindrical wall of the vessel may extend over a greater portion of the circumference of the vessel than what is shown here. The involute connection pieces may also extend in a helical path around the vessel.

It is true that the connection pieces as shown exhibit essentially rectangular openings in the wall of the vessel, but it is implied that also other shapes of the openings are possible.

Similarly different cross-section shapes of the involute connection piece varying along the length of the connection piece can exist within the scope of the invention.

In the embodiment of the invention described above, both the openings in the cylindrical wall of the vessel are arranged for cooperation with involute connection pieces according to the invention, but considerable advantages can also be obtained in a separator according to the invention in which only one of the side openings in connected to such an involute connection piece.

The invention is not limited to the embodiment described above and illustrated in the FIGURE, but can be modified in many ways within the limits of the claim.

What I claim is:

1. In a dynamic dense media separator comprising a cylindrical separation vessel having an axial outlet for separated material fractions of a lower density, at one end of said vessel, an inlet for dense media on the cylindrical surface of the separation vessel at the same end thereof as said outlet, and an axial inlet for material to be separated, at the opposite end of said separation vessel, and an outlet on the cylindrical surface of said separation vessel at the same end thereof as said material inlet for separated material fractions of higher density together with dense media; the improvement in which said outlet for separated material fractions of higher density together with dense media and said inlet for dense media both have the shape of an involute connection piece which at least partially surrounds the separation vessel and is bent substantially in the direction of the circumference of the vessel and has an outer wall whose radius of curvature progressively increases in the direction of travel of said separated material fractions of the higher density that exit together with dense media, said involute connection piece having an opening in the wall of the separation vessel which occupies about 90° of the circumference of the vessel.

2. A separator as claimed in claim 1, in which said opening in the involute connection piece is substantially rectangular.

3. A separator as claimed in claim 1, in which said involute connection piece is bent outside its part which is connected to the separation vessel, in a curve which is a smooth continuation of the curve of said outer wall thereof.

4. A separator as claimed in claim 1, in which said outlet for separated material fractions of higher density together with dense media, is disposed at a higher elevation than said inlet for dense media.

* * * * *